United States Patent [19]

Hayashi

[11] Patent Number: 4,748,106

[45] Date of Patent: May 31, 1988

[54] COLOR PHOTOGRAPHIC LIGHT-SENSITIVE MATERIALS CONTAINING SPECIFIED TABULAR GRAINS

[75] Inventor: Yasuhiro Hayashi, Kanagawa, Japan

[73] Assignee: Fuji Photo Film Co., Ltd., Kanagawa, Japan

[21] Appl. No.: 886,466

[22] Filed: Jul. 17, 1986

[30] Foreign Application Priority Data

Jul. 18, 1985 [JP] Japan ..... 60-158894

[51] Int. Cl.[4] ..... G03C 1/02

[52] U.S. Cl. ..... 430/503; 430/434; 430/567; 430/569

[58] Field of Search ..... 430/567, 569, 434, 503

[56] References Cited

U.S. PATENT DOCUMENTS

| | | | |
|---|---|---|---|
| 3,402,046 | 9/1968 | Zwick | 430/504 |
| 3,574,628 | 4/1971 | Jones | 430/567 |
| 3,658,536 | 4/1972 | Wolf | 430/506 |
| 4,433,048 | 2/1984 | Solberg et al. | 430/434 |
| 4,434,226 | 2/1984 | Wilgus et al. | 430/434 |
| 4,459,353 | 7/1984 | Maskasky | 430/434 X |
| 4,672,027 | 6/1987 | Daubendiek et al. | 430/505 |

FOREIGN PATENT DOCUMENTS 0111919 6/1984 European Pat. Off. .

*Primary Examiner*—Mukund J. Shah

*Attorney, Agent, or Firm*—Sughrue, Mion, Zinn, Macpeak, and Seas

[57] ABSTRACT

A color photographic light-sensitive material comprising a support having thereon at least one layer each of a red-sensitive emulsion, a green-sensitive emulsion and a blue-sensitive emulsion, wherein at least 50% of the total projected area of silver halide grains contained in at least one of the emulsion layers is tabular grains of silver bromide, silver iodobromide, silver chlorobromide or silver iodochlorobromide which has a thickness of less than 0.12 micron, a diameter of less than 0.6 micron and a mean aspect ratio of at least 5. The color photographic light-sensitive material has an improved sharpness.

4 Claims, No Drawings

COLOR PHOTOGRAPHIC LIGHT-SENSITIVE MATERIALS CONTAINING SPECIFIED TABULAR GRAINS

FIELD OF THE INVENTION

The present invention relates to color photographic light-sensitive materials and, more particularly, to color photographic light-sensitive materials with improved sharpness.

BACKGROUND OF THE INVENTION

In the field of art related to the manufacture of color photographic light-sensitive materials, an improvement in sharpness has been required as one of the important means towards improving the color image reproduction, and much research has been undertaken for improving the sharpness.

It is well known that the sharpness of a light-sensitive material is much dependent upon the scattering of light by the silver halide grains it contains and James: *The Theory of the Photographic Process,* 4th Ed. (1977), pages 580 to 585 states that in the grain size range of 0.6 to 0.4 microns, scattering of light is great with a marked deterioration in sharpness.

Particularly in a multilayer color photographic light-sensitive material comprising red-sensitive, green-sensitive and blue-sensitive layers, the very multilayer structure results in an accumulation of scattered light therein to cause a remarkable decrease in the sharpness of the underlying emulsion layers.

U.S. Pat. No. 3,402,046 describes a method for achieving an improved sharpness which comprises employing relatively coarse grains, at least 0.7 micron, which cause less scattering of light, in the blue-sensitive emulsion layer which is the uppermost emulsion layer of a multilayer color photographic light-sensitive material.

The method described in U.S. Pat. No. 3,658,536 comprises disposing one of two blue-sensitive emulsion layers below a green-sensitive emulsion layer or a red-sensitive emulsion layer for achieiving an improved sharpness.

However, as these methods of necessity employ coarse grains larger than those necessary as blue-sensitive emulsion grains, they have the disadvantage that the graininess of the blue-sensitive emulsion layer is deteriorated.

U.S. Pat. No. 4,439,520 teaches a color photographic light-sensitive material in which the sharpness, sensitivity and graininess have been improved by the use, in at least one of green-sensitive and red-sensitive emulsion layers, of tabular silver halide grains having a thickness of less than 0.3 micron, a diameter of at least 0.6 micron and an average aspect ratio (diameter/thickness) of greater than 8. However, this patent does not show tabular silver halide grains less than 0.6 micron.

SUMMARY OF THE INVENTION

An object of the present invention is to provide a color photographic light-sensitive material having an improved sharpness.

This and other objects of the present invention have been attained by providing a color photographic light-sensitive material which comprises a support having thereon at least one layer each of a red-sensitive emulsion, a green-sensitive emulsion and a blue-sensitive emulsion, wherein at least 50% of the total projected area of silver halide grains contained in at least one of said emulsion layers is tabular grains of silver bromide, silver iodobromide, silver chlorobromide or silver iodochlorobromide having a thickness of less than 0.12 micron, a diameter of less than 0.6 micron and a mean aspect ratio of at least 5.

DETAILED DESCRIPTION OF THE INVENTION

A tabular silver halide grain in general is a tabular grain having two parallel surfaces and the term "thickness" is used herein to mean the distance between the two parallel surfaces or planes defining the tabular silver halide grain.

The proportion of tabular silver halide grains in the emulsion containing tabular silver halide grains which is used in accordance with the present invention is preferably at least 50%, more preferably at least 70%, and particularly preferably at least 90%, with respect to the total projected area of silver halide grains present.

The tabular silver halide grains can be used in a monodispersed system in regard to the distribution of the diameter and/or thickness of silver halide grains as described in Japanese Patent Publication No. 11386/72, for instance.

The term "monodispersed system" of tabular silver halide grains means a dispersion system such that 95% of the grains each has a grain diameter which is within the range of the number average grain size ±60%, preferably ±40%. The term "number average grain size" is the number average of projected area diameters of silver halide grains.

As regards the halogen composition of such tabular silver halide grains, silver bromide, silver iodobromide, silver chlorobromide and silver iodochlorobromide are preferred.

For use in high sensitivity light-sensitive materials, silver iodobromide is especially desirable. In the case where silver iodobromide is used, its silver iodide content is generally not more than 40 mol%, preferably not more than 20 mol%, and more preferably not more than 10 mol%.

The tabular grain may have a uniform halogen composition or the different halogen compositions which a plurality of layers are respectively made of.

For example, when silver iodobromide is employed, the tabular silver iodobromide grain may have a layer structure consisting of a plurality of layers varying in iodide content. For preferred examples of the halogen composition of tabular silver halide grains and of the intra-grain distribution of halogens, reference may be made to Japanese Patent Application (OPI) Nos. 113927/83, 113928/83, 99433/84, 119344/84, 119350/84 and so on (the term "OPI" as used herein refers to a "published unexamined Japanese patent application").

As the tabular grain, one bounded by (111) face or (100) face or one having the (111) and (100) faces can be selected.

In regard to latent image forming sites, the grain in which the latent image is formed predominantly in the surface layer and the grain in which the latent image is produced predominantly in the interior may be employed. Further, the grains in which latent image forming sites are located both on the surface and in the interior may also be utilized.

The procedure for producing such tabular silver halide grains is described below.

The production of tabular silver halide grains may be carried out by a suitable combination of methods known in the art.

By way of illustration, such silver halide grains can be prepared by causing seed crystals to grow by simultaneous addition of silver and halogen solutions while maintaining pBr at a comparatively low level not higher than pBr 1.3.

The size of tabular silver halide grains can be adjusted by controlling the temperature, the type and amount of solvent, the rate of addition of the silver salt and halide during growth of grains, etc.

In the production of tabular silver halide grains for use in the present invention, silver halide solvents can be employed, if necessary.

The silver halide solvents which can be used include ammonia, thioethers, and thioureas.

For detailed discussions on tabular silver halide grains and silver halide emulsions containing them, reference may be made to U.S. Pat. Nos. 4,434,226, 4,439,520, 4,414,310, 4,425,425, 4,399,215, 4,435,501, 4,386,156, 4,400,463, 4,414,306 and 4,425,426, European Pat. No. 84,637A2, Japanese Patent Application (OPI) No. 99433/84 and *Research Disclosure,* No. 22534 (January, 1983), for instance.

The tabular silver halide grains used in the present invention may be subjected to chemical sensitization, if necessary.

The useful methods for chemical sensitization include, among others, gold sensitization (e.g., U.S. Pat. Nos. 2,448,060 and 3,320,069), other noble metal sensitization using iridium, platinum, rhodium, palladium or the like (e.g., U.S. Pat. Nos. 2,448,060, 2,566,245 and 2,566,263), sulfur sensitization with a sulfur-containing compound (e.g., U.S. Pat. No. 2,222,264), and reduction sensitization using a tin salt, a polyamine or the like (e.g., U.S. Pat. Nos. 2,487,850, 2,518,698 and 2,521,925). These methods may be used either singly or in a suitable combination.

From the standpoint of high sensitization, in particular, the tabular silver halide grains for use in the present invention are preferably subjected to gold or sulfur sensitization or a combination thereof.

The aforementioned grain characteristics of the high aspect ratio tabular grain emulsion can be easily confirmed by the techniques well known to those skilled in the art. The term "aspect ratio" as used herein means the ratio of diameter to thickness of the grain. The "diameter" of a grain is defined as the diameter of a circle having the same area as the projected area of the grain on an electron micrograph. On a shadowed electron micrograph of an emulsion sample, one may measure the thickness and diameter of each individual grain and even identify tabular grains with a thickness of less than 0.12 micron. Then, one may calculate the aspect ratio of each tabular grain and arrive at the mean aspect ratio of the grains by averaging the aspect ratios of all the tabular grains meeting the thickness criterion of less than 0.12 micron in the sample. According to the above definition, the mean aspect ratio is the average of the aspect ratio of individual tabular grains. Actually, it is usually more expedient to find the mean thickness and mean diameter of tabular grains with a thickness of less than 0.12 micron and calculate the mean aspect ratio from such mean diameter and thickness. Whether one uses the mean aspect ratio found by averaging the individual aspect ratios or the mean aspect ratio computed from the mean diameter and mean thickness, the result is nearly the same within the permissible variation of the grain measurement intended. Then, one may total the projected areas of silver iodobromide grains meeting the thickness and diameter criterion, separately total the projected area of the remaining silver iodobromide grains on the micrograph and, from these two total figures, calculate the proportion of grains meeting the thickness and diameter criterion in the total population of silver iodobromide grains.

The term "projected area" is used herein in the same sense as the projection area and projective area, both of which are the common terminologies in the art. (See, for example, James and Higgins, *Fundamentals of Photographic Theory,* Morgan and Morgan, New York, p. 15.)

The tabular silver halide grains used in the present invention preferably have a thickness of from 0.02 to 0.12 micron, a diameter of from 0.05 to 0.6 micron and a mean aspect ratio of from 5 to 30.

The use of small sized tabular silver halide grains in a color photographic light-sensitive material containing silver halide grains with a mean grain size of up to 0.4 micron results in a remarkable improvement in sharpness.

In photographic emulsions other than said tabular silver halide emulsion in the photographic light-sensitive material according to the present invention, any of silver bromide, silver iodobromide, silver iodochlorobromide, silver chlorobromide and silver chloride can be employed. The preferred silver halide is a silver iodobromide or silver iodochlorobromide containing at most about 30 mol% of silver iodide. Particularly preferred is silver iodobromide containing about 0.1 mol% to about 15 mol% of silver iodide.

The silver halide grains in the photographic emulsion may be so-called regular grains such as cubes, octahedrons, tetradecahedrons, etc., irregular grains such as spheres, or those having lattice defects such as twin planes, or a composite thereof.

As regards the diameter of silver halide grains, both the micrograins less than about 0.1 micron and the large grains with a projected area diameter of up to about 10 microns can be employed, and both a monodispersed emulsion having a narrow grain size distribution or a polydispersed emulsion having a broad distribution can be employed.

The silver halide photographic emulsions that can be employed in the practice of the present invention can be manufactured by conventional methods, for example, the method described in *Research Disclosure,* No. 17643 (December, 1978), pp. 22 and 23 "I. Emulsion Preparation and Types", and *Research Disclosure,* No. 18716 (November, 1979), p. 648.

The photographic emulsion used in accordance with the present invention can be prepared by the methods described in P. Glafkides, *Chimie et Physique Photographique,* Paul Montel (1967); G. F. Duffin, *Photographic Emulsion Chemistry,* The Focal Press (1966); and Zelikman et al., *Making and Coating Photographic Emulsion,* The Focal Press (1964), for instance. Thus, any of acidic, neutral, ammonia and other methods can be employed. In the method involving reaction of a soluble silver salt with a soluble halogen salt, any of the single jet method, the double jet method and a combination thereof can be utilized. The method (the so-called reverse mixing method) in which grains are formed in the presence of an excess of silver ion can also be employed. As a mode of the double jet method, the controlled double jet method wherein pAg in the liquid phase where the silver halide is formed is maintained at a constant level can also be employed. This method yields a silver halide emulsion which is regular in crystal shape and nearly uniform in grain size.

It is also possible to admix two or more different silver halide emulsions prepared independently.

The silver halide emulsion composed of regular grains can be obtained by controlling the pAg and pH during grain formation. For detailed information on this procedure, reference may be made to *Photographic Science and Engineering,* 6, pp. 159–165 (1962); *Journal of Photographic Science,* 12, pp. 242–251 (1964); U.S. Pat. No. 3,655,394 and British Pat. No. 1,413,748, for instance.

The monodispersed emulsion is typically exemplified by an emulsion in which at least about 95 wt% of silver halide grains each has a grain diameter which is within the range of the mean grain diameter ±40%. An emulsion in which at least about 95% by weight or at least about 95% by number of silver halide grains each has a grain diameter which is within the range of the mean grain diameter ±20% can be preferably employed in accordance with the present invention. The methods for preparing such emulsions are described in U.S. Pat. Nos. 3,574,628 and 3,655,394, and British Pat. No. 1,413,748, for instance. Moreover, monodispersed emulsions such as described in Japanese Patent Application (OPI) Nos. 8600/73, 39027/76, 83097/76; 137133/78, 48521/79, 99419/79, 37635/83 and 49938/83, for instance, can also be successfully employed in the practice of the present invention.

Tabular grains with a mean aspect ratio of at least about 5 can also be employed for the purposes of the present invention. Tabular grains can be easily prepared by the methods described in Gutoff, *Photographic Science and Engineering,* 14, pp. 248–257 (1970); U.S. Pat. Nos. 4,434,226, 4,414,310, 4,433,048 and 4,439,520 and British Pat. No. 2,112,157, for instance. The advantages of using tabular grains in terms of improved efficiencies of sensitization with sensitizing dyes, improved graininess, increased sharpness, etc., are described in U.S. Pat. No. 4,434,226 referred to hereinbefore, for instance.

The grain may be one uniform in crystal structure or a heterophasic grain differing in halogen composition between the interior and exterior parts thereof. Grains having a layer structure may also be employed. These emulsion grains are disclosed in British Pat. No. 1,027,146, U.S. Pat. Nos. 3,505,068 and 4,444,877 and Japanese Patent Application (OPI) No. 143331/85, for instance. Moreover, silver halide grains of different compositions fused by epitaxial junction or fused to compounds other than silver halides, such as silver rhodanate, lead oxide, etc., may also be employed. Such emulsion grains are disclosed in U.S. Pat. Nos. 4,094,684, 4,142,900 and 4,459,353, British Pat. No. 2,038,792, U.S. Pat. Nos. 4,349,622, 4,395,478, 4,433,501, 4,463,087, 3,656,962 and 3,852,067 and Japanese Patent Application (OPI) No. 162540/84, for instance.

Further, a mixture of grains having different crystal shapes may be employed.

For use in the present invention, the emulsion is generally subjected to physical ripening, chemical ripening and spectral sensitization. The additives that can be used in such processes are described in *Research Disclosure,* No. 17643 (December, 1978) and No. 18716 (November, 1979) and the corresponding positions in the literature are shown below in the table.

The known photographic additives that can be used in the practice of the present invention are also given in the above two issues of *Research Disclosure* and the corresponding positions are indicated in the same table.

Particularly when fine grained emulsions are used as in the present invention, the use of an anti-irradiation dye is remarkably effective in improving the sharpness.

| | Additive Agent | RD 17643 | RD 18716 |
|---|---|---|---|
| 1 | Chemical sensitizers | page 23 | page 648, right column |
| 2 | Sensitivity increasing agents | — | page 648, right column |
| 3 | Spectral sensitizers & supersensitizers | pages 23–24 | page 648, right column to page 649, right column |
| 4 | Antifoggants & stabilizers | pages 24–25 | page 649, right column |
| 5 | Light absorbers, filter dyes, infrared absorbers | pages 25–26 | page 649, right column to page 650, left column |
| 6 | Stain inhibitors | page 25 | page 650, left column to right column |
| 7 | Hardeners | page 26 | page 651, left column |
| 8 | Binders | page 26 | page 651, left column |
| 9 | Plasticizers & lubricating agents | page 27 | page 650, right column |
| 10 | Coating aids & surfactants | pages 26–27 | page 650, right column |
| 11 | Antistatic agents | page 27 | page 650, right column |

Various couplers can be used in the present invention. Specific examples of such couplers are given in the patents mentioned in *Research Disclosure,* No. 17643 (VII-C to G) referred to hereinbefore. As color-forming couplers, the couplers giving the three color primaries in subtractive color processes (i.e., yellow, magenta and cyan) are important, and to mention specific examples of nondiffusible 4-equivalent or 2-equivalent couplers, the couplers described in the patents referred to in the above issue of *Research Disclosure,* No. 17643 (VII-C and D) and the following couplers can be advantageously employed in the present invention.

The yellow couplers that can be used in the present invention are typically exemplified by acylacetamide type couplers which have ballasting groups and are hydrophobic. Specific examples thereof are given in U.S. Pat. Nos. 2,407,210, 2,875,057 and 3,265,506, for instance. In the present invention, the use of 2-equivalent couplers are preferred, and representative examples of these couplers include the yellow couplers having oxygen atom-linked coupling-off groups described in U.S. Pat. Nos. 3,408,194, 3,447,928, 3,933,501 and 4,022,620 and the yellow couplers having nitrogen atom-linked coupling-off groups described in Japanese Patent Publication No. 10739/83, U.S. Pat. Nos. 4,401,752 and 4,326,024, *Research Disclosure,* No. 18053 (April, 1979), British Pat. No. 1,425,020, West German Patent Application (OLS) Nos. 2,219,917, 2,261,361, 2,329,587 and 2,433,812. The α-pivaloylacetanilide type couplers are beneficial in terms of fastness of colored dye, particularly in terms of light fastness, while the α-benzoylacetanilide type couplers yield high color densities.

The magenta couplers that can be used in the present invention include the ballasted, hydrophobic couplers of indazolone type or cyanoacetyl type, particularly those of 5-pyrazolone type or pyrazoloazole type. The 5-pyrazolone type couplers are preferably substituted in the 3-position by an arylamino or acylamino group from the standpoint of the hue and density of colored dyes.

Representative examples of such couplers are described in U.S. Pat. Nos. 2,311,082, 2,343,703, 2,600,788, 2,908,573, 3,062,653, 3,152,896 and 3,936,015, for instance. As the coupling-off groups in 2-equivalent 5-pyrazolone type couplers, the nitrogen atom-linked coupling-off groups described in U.S. Pat. No. 4,310,619 and the arylthio groups described in U.S. Pat. No. 4,351,897 are particularly preferred. The 5-pyrazolone type couplers having ballasting groups as set forth in European Pat. No. 73,636 yield high color densities. As examples of pyrazoloazole type couplers, the pyrazolobenzimidazoles described in U.S. Pat. No. 3,369,879 and, preferably, the pyrazolo[5,1-c][1,2,4]triazoles mentioned in U.S. Pat. No. 3,725,067, the pyrazolotetrazoles described in *Research Disclosure,* No. 24220 (June, 1984) and Japanese Patent Application (OPI) No. 33552/85, and the pyrazolopyrazoles described in *Research Disclosure,* No. 24230 (June, 1984) and Japanese Patent Application (OPI) No. 43659/85 may be mentioned. In view of the scarcity of yellow side absorptions of colored dyes and in terms of light fastness, the imidazo[1,2-b]pyrazoles described in U.S. Pat. No. 4,500,630 are preferred, and the pyrazolo[1,5-b][1,2,4]triazoles described in European Pat. No. 119,860A are especially desirable.

The cyan couplers that can be employed in the present invention include the hydrophobic, nondiffusible couplers of naphthol type and phenol type. Typical examples of such cyan couplers include the naphthol type couplers described in U.S. Pat. No. 2,474,293 and, preferably, the 2-equivalent naphthol type couplers having oxygen atom-linked coupling-off groups described in U.S. Pat. Nos. 4,052,212, 4,146,396, 4,228,233 and 4,296,200. Examples of the phenol type couplers are given in U.S. Pat. Nos. 2,369,929, 2,801,171, 2,772,162 and 2,895,826, for instance.

Cyan couplers fast to humidity and temperature can be used with advantage in the practice of the present invention. Among typical examples of such cyan couplers are the phenol type cyan couplers having an ethyl or higher alkyl group in the meta-position of the phenol nucleus as described in U.S. Pat. No. 3,772,002, the 2,5-diacylamino-substituted phenol type couplers described in U.S. Pat. Nos. 2,772,162, 3,758,308, 4,126,396, 4,334,011 and 4,327,173, West German Patent Application (OLS) No. 3,329,729 and European Pat. No. 121,365, for instance, and the phenol type couplers having a phenylureido group in the 2-position and an acylamino group in the 5-position as disclosed in U.S. Pat. Nos. 3,446,622, 4,339,999, 4,451,559 and 4,427,767.

In color photographic light-sensitive materials for picture-taking use, it is preferable to use colored couplers together for masking purposes, in order to correct unwanted absorptions of colored dyes. As typical examples of such colored couplers, there may be mentioned the yellow colored magenta couplers described in U.S. Pat. No. 4,163,670 and Japanese patent Publication No. 39413/82, for instance, and the magenta colored cyan couplers described in U.S. Pat. Nos. 4,004,929 and 4,138,258 and British Pat. No. 1,146,368, for instance. Other colored couplers are described in *Research Disclosure,* No. 17643, VII-G, referred to hereinbefore.

For improving graininess, couplers giving rise to dyes having a controlled degree of diffusibility can be utilized. As to specific examples of such couplers, U.S. Pat. No. 4,366,237 and British Pat. No. 2,125,570 give examples of magenta couplers and European Pat. No. 96,570 and West German Patent Application (OLS) No. 3,234,533 give examples of yellow, magenta or cyan couplers.

The dye-forming couplers and the special couplers mentioned above may each be dimerized or oligo- or polymerized. Examples of such polymeric dye-forming couplers are given in U.S. Pat. Nos. 3,451,820 and 4,080,211. Specific examples of polymeric magenta couplers are mentioned in British Pat. No. 2,102,173 and U.S. Pat. No. 4,367,282.

Couplers which release a photographically useful group on coupling can also be used advantageously in the practice of the present invention. As DIR couplers adapted to release a development inhibitor, couplers taught by the patents referred to in the aforecited *Research Disclosure,* No. 17643, VII-F are useful.

Preferred for use in combination with the present invention are the developer-inactivating type DIR couplers exemplified by those described in Japanese Patent Application (OPI) No. 151944/82, the timing group type DIR couplers exemplified by those mentioned in U.S. Pat. No. 4,248,962 and Japanese Patent Application (OPI) No. 154234/82, and the reaction type DIR couplers exemplified by those mentioned in Japanese Patent Application (OPI) No. 184248/85. Particularly advantageous are the developer-incativating type DIR couplers described in Japanese Patent Application (OPI) Nos. 151944/82, 217932/83, 218644/85, 225156/85 and 233650/85, etc., and the reaction type DIR couplers described in Japanese Patent Application (OPI) No. 184248/85, for instance.

In the light-sensitive material according to the present invention, there may be incorporated those couplers which are adapted to imagewise release a nucleating agent or a development accelerator or a precursor thereof at development. Specific examples of such compounds are given in British Pat. Nos. 2,097,140 and 2,131,188. Couplers such as those adapted to release a nucleating agent having an adsorbent affinity for silver halides, for instance, are particularly desirable and examples of such couplers are given in Japanese Patent Application (OPI) Nos. 157638/84 and 170840/84, for instance.

The various supports that can be advantageously utilized in the present invention are described in the aforecited *Research Disclosure,* No. 17643, at page 28 and *Research Disclosure,* No. 18716, at page 647, right column to page 648, left column.

The color photographic light-sensitive material according to the present invention can be developed by the conventional development processes described in the above-mentioned *Research Disclosure,* No. 17643, pages 28 and 29 and *Research Disclosure,* No. 18716, page 651, left column to right column.

In color photographic processing, the light-sensitive material following color development is generally bleached. This bleaching may be carried out simultaneously with fixing or independently of the fixing process. As bleaching agents, compounds of polyvalent metals such as iron (III), cobalt (III), chromium (VI), copper (II), etc., peracids, quinones, nitroso compounds and so on can be employed. For example, ferricyanides, dichromates, organic complex salts of iron (III) or cobalt (III), such as complex salts with aminopolycarboxylic acids such as ethylene-diaminetetraacetic acid, nitrilotriacetic acid, 1,3-diamino-2-propanoltetraacetic acid, etc., or with organic acids such as citric acid, tartaric acid, malic acid, etc., persulfates, permanganates, nitrosophenols and so on can be utilized. Among these bleaching agents, potassium ferricyanide, sodium ethylenediaminetetraacetato ferrate and ammonium ethylenediaminetetraacetato ferrate are particularly useful. The Fe (III) ethylenediaminetetraacetic acid complex salts are useful not only in an independent bleach bath but also in a bleach-fix bath.

After development and bleach-fixing or fixing, the color photographic light-sensitive material is usually washed or stabilized.

The washing is generally carried out in a countercurrent system using two or more baths to save water. Regarding the stabilization process, which takes the place of washing, a multistage countercurrent stabilization process described in Japanese Patent Application (OPI) No. 8543/82 may be mentioned as a typical example. This process requires 2 to 9 countercurrent baths. In the stabilization baths, various compounds are incorporated for stabilizing the image. For example, various buffers for stabilizing the film pH (e.g., pH 3 to 8) (e.g., boric acid salts, metaboric acid salts, borax, phosphates, carbonates, potassium hydroxide, sodium hydroxide, aqueous ammonia, monocarboxylic acids, dicarboxylic acids, polycarboxylic acids, etc., are used in suitable combinations) and formalin may be mentioned. If necessary, water softening agents (inorganic phosphates, aminopolycarboxylic acids, organic phosphates, aminopolyphosphonic acids, phosphonocarboxylic acids, etc.), sterilizer (benzoisothiazolinone, isothiazolone, 4-thiazolinebenzimidazole, halogenated phenol compounds, etc.), surfactants, brightening agents, film hardeners, and other additives may be incorporated and, for any given purpose, two or more different compounds may be used in combination.

As the post-processing film pH adjusting agent, it is preferable to use ammonium salts such as ammonium chloride, ammonium nitrate, ammonium sulfate, ammonium phosphate, ammonium sulfite, ammonium thiosulfate and so on.

The present invention can be applied to a variety of color light-sensitive materials. As typical examples, a color negative film, a color reversal film, a color paper, a color positive film and a color reversal paper may be mentioned. The present invention can also be applied to black-and-white light-sensitive materials utilizing a mixture of three color couplers as described in *Research Disclosure,* No. 17123 (July, 1978), for instance.

EXAMPLES

The following examples are intended to illustrate the present invention in further detail and should not be construed as limiting the invention.

(1) Preparation of Tabular Silver Halide Grain Emulsions

Emulsion A:

In an atmosphere of pBr 1.3, an aqueous solution containing 0.1 mol of silver nitrate and an aqueous solution containing 0.1 mol of KBr and KI, as taken together, were added to 1 liter of a stirred KI-free aqueous solution of gelatin kept at a constant temperature of 55° C. by the double jet method over a period of 10 minutes.

The resulting tabular silver halide grains had a mean grain diameter of 0.54 micron and a mean grain thickness of 0.10 micron. In this emulsion, the grains with a diameter of less than 0.6 micron, a thickness of less than 0.12 micron and an aspect ratio of at least 5 accounted for at least 50% of the total projected area of silver halide grains. The silver iodide content was 2.5 mol%. This emulsion was chemically sensitized with gold and sulfur in combination to provide Emulsion A.

Emulsion B:

An emulsion was prepared in the same manner as Emulsion A except that the temperature of the aqueous gelatin solution was maintained at 45° C. The resulting grains had a mean diameter of 0.42 micron and a thickness of 0.07 micron, and the grains with a diameter of less than 0.6 micron, a thickness of less than 0.12 micron and an aspect ratio of at least 5 accounted for more than 50% of the total projected area of the silver halide grains present.

This emulsion was chemically sensitized with gold and sulfur in combination to provide Emulsion B. The silver iodide content was 2.5 mol%.

(2) Preparation of a Control Emulsion

Using the method described in U.S. Pat. No. 3,320,069, a silver iodobromide emulsion containing 2.5 mol% of silver iodide and having a mean aspect ratio of at most 2 was prepared.

Emulsion C:

There was prepared an emulsion having a mean grain diameter of 0.35 micron, a mean grain thickness of 0.25 micron and a mean volume approximating that of Emulsion A and this emulsion was chemically sensitized with gold and sulfur in combination to provide Emulsion C.

Emulsion D:

There was prepared an emulsion having a mean grain diameter of 0.25 micron, a mean grain thickness of 0.20 micron and a mean volume approximating that of Emulsion B and this emulsion was chemically sensitized with gold and sulfur in combination to provide Emulsion D.

Then, using cellulose triacetate film supports, Multilayer Color Light-Sensitive Materials 101 to 104 each consisting of the following layers were prepared.

First Layer: An Antihalation Layer
- A gelatin layer containing:
  - Black colloidal silver 0.30 g/m$^2$ Second Layer: An Intermediate Layer
- A gelatin layer containing:
  - Compound H-1 0.18 g/m$^2$ Third Layer: A First Red-Sensitive Emulsion Layer
- A gelatin layer containing:
  - Silver iodobromide emulsion (silver coverage) (silver iodide 4 mol%, average grain size 0.08 μm) 0.38 g/m$^2$
  - Sensitizing Dye I $7.0\times10^{-5}$ mol/mol Ag
  - Sensitizing Dye II $2.0\times10^{-5}$ mol/mol Ag
  - Sensitizing Dye III $2.8\times10^{-4}$ mol/mol Ag
  - Sensitizing Dye IV $2.0\times10^{-5}$ mol/mol Ag
  - Coupler C-3 0.40 g/m$^2$
  - Coupler C-4 0.02 g/m$^2$
  - Coupler C-5 0.02 g/m$^2$ Fourth Layer: A Second Red-Sensitive Emulsion Layer
- A gelatin layer containing:
  - Silver iodobromide emulsion (silver coverage) (silver iodide 4 mol%, average grain size 0.16 μm) 0.13 g/m$^2$
  - Sensitizing Dye I $5.2\times10^{-5}$ mol/mol Ag
  - Sensitizing Dye II $1.5\times10^{-5}$ mol/mol Ag
  - Sensitizing Dye III $2.1\times10^{-4}$ mol/mol Ag
  - Sensitizing Dye IV $1.5\times10^{-5}$ mol/mol Ag
  - Coupler C-3 0.20 g/m$^2$
  - Coupler C-4 0.01 g/m$^2$
  - Coupler C-5 0.01 g/m$^2$ Fifth Layer: A Third Red-Sensitive Emulsion Layer
- A gelatin layer containing:

Silver iodobromide emulsion (silver coverage) (silver iodide 4 mol%, average grain size 0.25 μm) 0.18 g/m²
Sensitizing Dye I $5.5\times10^{-5}$ mol/mol Ag
Sensitizing Dye II $1.6\times10^{-5}$ mol/mol Ag
Sensitizing Dye III $2.2\times10^{-5}$ mol/mol Ag
Sensitizing Dye IV $1.6\times10^{-5}$ mol/mol Ag
Coupler C-3 0.10 g/m²

Sixth Layer: An Intermediate Layer
A gelatin layer containing:
Compound H-1 0.02 g/m²

Seventh Layer: A First Green-Sensitive Emulsion Layer
A gelatin layer containing:
Silver iodobromide emulsion (silver coverage) (silver iodide 2.5 mol%, average grain size 0.08 μm) 0.35 g/m²
Sensitizing Dye V $4.0\times10^{-4}$ mol/mol Ag
Sensitizing Dye VI $4.0\times10^{-5}$ mol/mol Ag
Coupler C-6 0.20 g/m²
Coupler C-7 0.04 g/m²
Coupler C-8 0.04 g/m²
Coupler C-4 0.01 g/m²

Eighth Layer: A Second Green-Sensitive Emulsion Layer
A gelatin layer containing:
Silver iodobromide emulsion (silver coverage) (silver iodide 2.5 mol%, average grain size 0.16 μm) 0.20 g/m²
Sensitizing Dye V $3.5\times10^{-4}$ mol/mol Ag
Sensitizing Dye VI $3.5\times10^{-5}$ mol/mol Ag
Coupler C-9 0.10 g/m²
Coupler C-7 0.001 g/m²
Coupler C-8 0.001 g/m²

Ninth Layer: A Third Green-Sensitive Emulsion Layer
A gelatin layer containing:
Silver Iodobromide Emulsion D (silver coverage) (silver iodide 2.5 mol%, average grain size 0.25 μm) 0.14 g/m²
Sensitizing Dye V $3.0\times10^{-4}$ mol/mol Ag
Sensitizing Dye VI $3.0\times10^{-5}$ mol/mol Ag
Coupler C-9 0.03 g/m²
Coupler C-8 0.001 g/m²

Tenth Layer: A Yellow Filter Layer
A gelatin layer containing:
Yellow colloidal silver 0.16 g/m²
Compound H-1 0.20 g/m²

Eleventh Layer: A First Blue-Sensitive Emulsion Layer
A gelatin layer containing:
Silver iodobromide emulsion (silver coverage) (silver iodide 2.5 mol%, average grain size 0.15 μm) 0.25 g/m²
Coupler C-10 0.68 g/m²

Twelfth Layer: A Second Blue-Sensitive Emulsion Layer
A gelatin layer containing:
Silver iodobromide emulsion (silver coverage) (silver iodide 2.5 mol%, average grain size 0.20 μm) 0.20 g/m²
Coupler C-10 0.16 g/m²

Thirteenth Layer: A Third Blue-Sensitive Emulsion Layer
A gelatin layer containing:
Silver Iodobromide Emulsion C (silver coverage) (silver iodide 2.5 mol%, average grain size 0.30 μm) 0.40 g/m²
Coupler C-10 0.14 g/m²

Fourteenth Layer: A First Protective Layer
A gelatin layer containing:
Ultraviolet Absorber C-1 0.20 g/m²
Ultraviolet Absorber C-2 0.30 g/m²

Fifteenth Layer: A Second Protective Layer
A gelatin layer containing:
Polymethyl methacrylate particles (diameter 1.5 μm) 0.05 g/m²

In addition to the above composition, Gelatin Hardener C-11 and a surfactant were incorporated in each layer. The sample thus prepared was designated Sample 101.

The compounds used in preparation of the samples are shown below.

Ultraviolet Absorber C-1

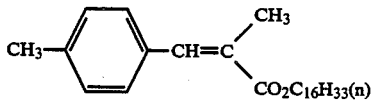

Ultraviolet Absorber C-2

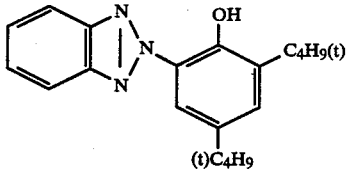

Coupler C-3

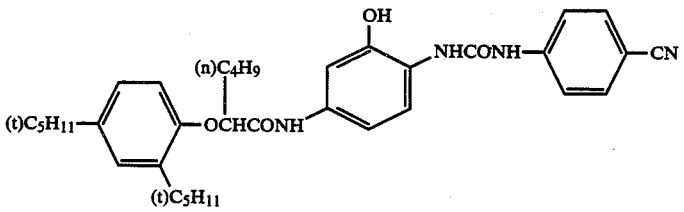

-continued
Coupler C-4
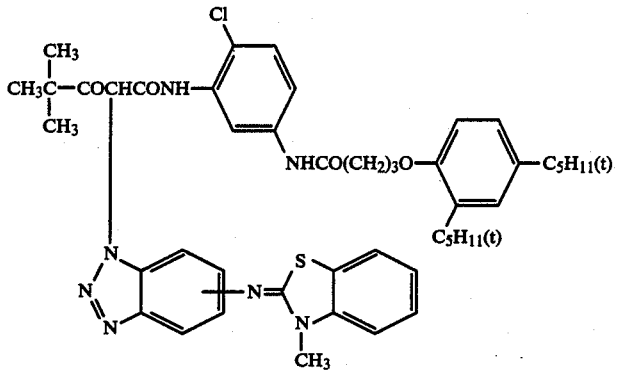
Coupler C-5
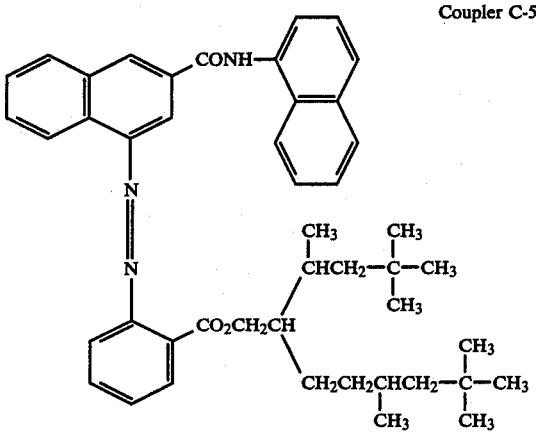
Coupler C-6
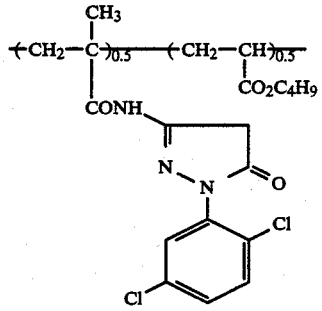
Coupler C-7
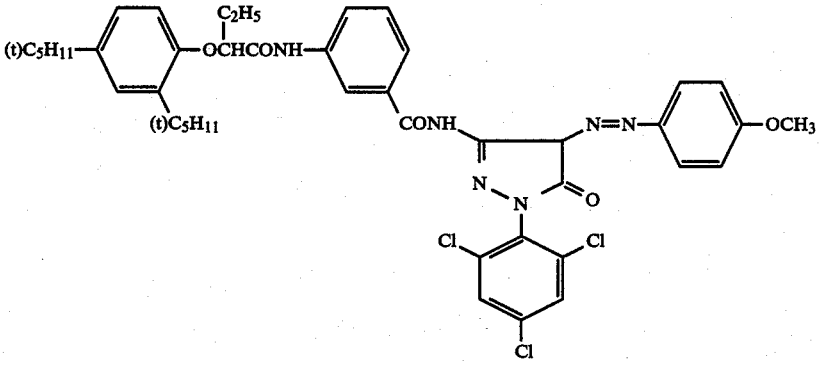
Coupler C-8
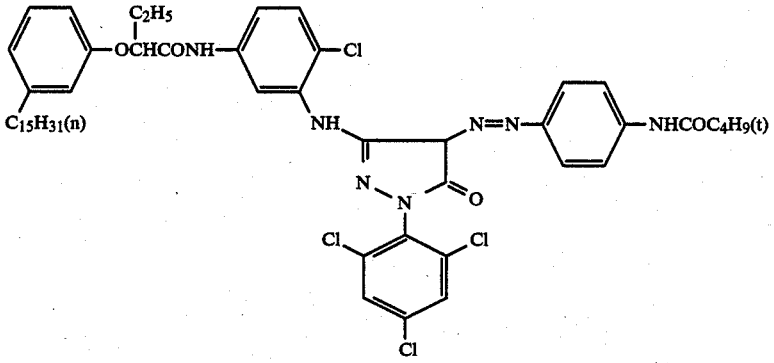

-continued
Coupler C-9
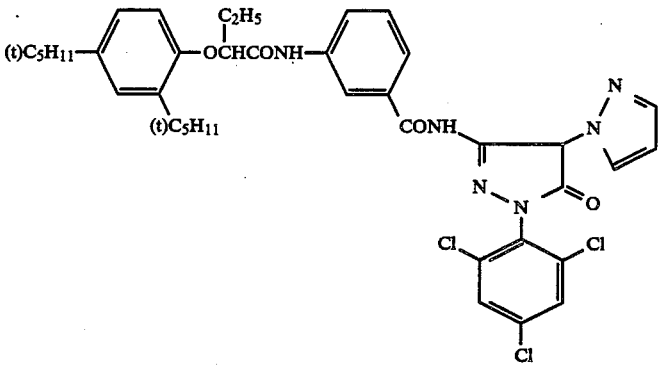
Coupler C-10
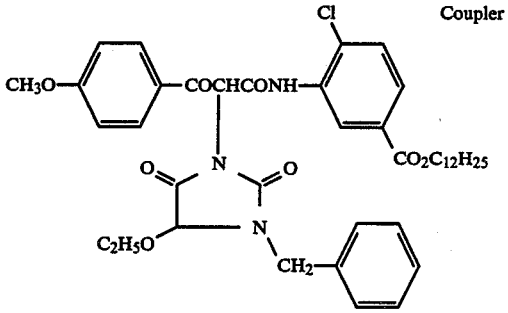
$(CH_2{=}CHSO_2CH_2CONHCH_2)_2$ Gelatin Hardener C-11
Compound H-1
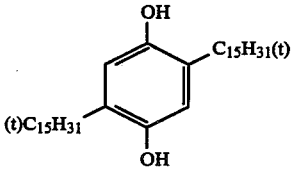
Sensitizing Dye I
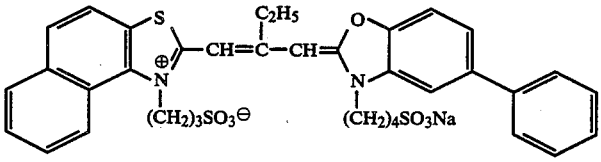
Sensitizing Dye II
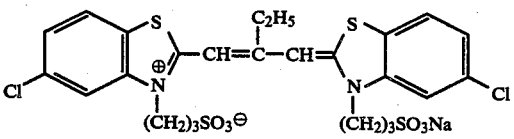
Sensitizing Dye III
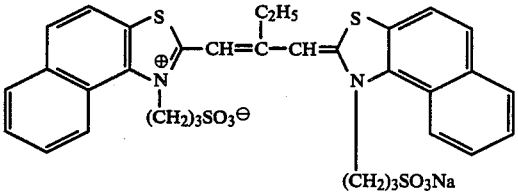
Sensitizing Dye IV
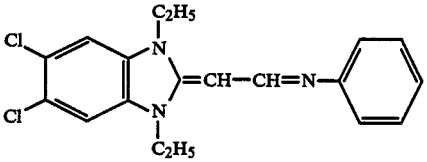
Sensitizing Dye V
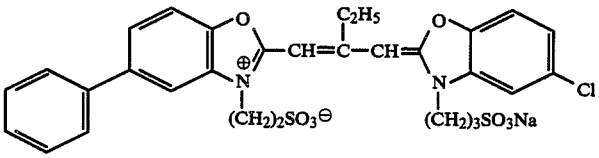

-continued

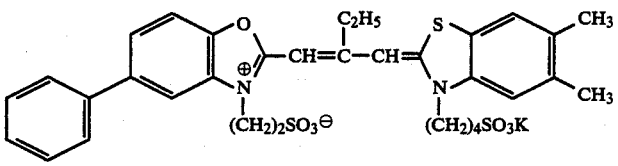

Sensitizing Dye VI

Sample 102 was prepared in the same manner as Sample 101 except that Emulsion A was used instead of Emulsion C in the third blue-sensitive emulsion layer in the thirteenth layer unit.

Sample 103 was also prepared in the same manner as Sample 101 except that Emulsion B was used instead of Emulsion D in a third green-sensitive emulsion layer in the ninth layer unit.

Sample 104 was prepared in the same manner as Sample 102 except that Emulsion A was used instead of Emulsion C in the third blue-sensitive layer in the thirteenth layer unit.

The above samples were exposed by the method described in ISO 5800 and processed according to the following schedule.

| Processing Step | Temperature (°C.) | Time |
|---|---|---|
| (1) Prebath | 27 ± 1 | 10 sec |
| (2) Unpacking and Spray Washing | 27 – 38 | 5 sec |
| (3) Color Development | 41.1 ± 0.1 | 3 min |
| (4) Stop | 27 – 38 | 30 sec |
| (5) Bleach Accelerator | 27 ± 1 | 30 sec |
| (6) Bleaching | 38 ± 1 | 3 min |
| (7) Washing | 27 – 38 | 1 min |
| (8) Fixing | 38 ± 1 | 2 min |
| (9) Washing | 27 – 38 | 2 min |
| (10) Stabilizing | 27 – 38 | 10 sec |

The compositions of the processing solutions used in the above steps were as follows.

| Recipes of Processing Solutions | As formulated |
|---|---|
| (1) Prebath | |
| Water (27–38° C.) | 800 ml |
| Borax ($10H_2O$) | 20.0 g |
| Sodium Sulfate (anhydrous) | 100 g |
| Sodium Hydroxide | 1.0 g |
| Water to make | 1.00 l |
| pH (27° C.) | 9.25 |
| (3) Color Development | |
| Water (21–38° C.) | 850 ml |
| Kodak Anti-Calcium No. 4: 40 wt % | 2.0 ml |
| Aqueous Solution of the Compound of the Following Formula: $N(CH_2PO_3Na_2)_2$ \| $CH_2PO_3HNa$ | |
| Sodium Sulfite (anhydrous) | 2.0 g |
| Kodak Anti-Fog No. 9: 3,5-Di- | 0.22 g |

-continued

| Recipes of Processing Solutions | As formulated |
|---|---|
| nitrobenzoic Acid | |
| Sodium Bromide (anhydrous) | 1.20 g |
| Sodium Carbonate (anhydrous) | 25.6 g |
| Sodium Hydrogencarbonate | 2.7 g |
| Color Developing Agent: 4-(N—Ethyl-N—β-methanesulfonamidoethyl)-n-toluidine | 4.0 g |
| Water to make | 1.00 l |
| pH (27° C.) | 10.20 |
| (4) Stop | |
| Water (21–38° C.) | 900 ml |
| 7.0 N Sulfuric Acid | 50 ml |
| Water to make | 1.00 l |
| pH (27° C.) | 0.9 |
| (5) Bleach Accelerator Bath | |
| Water | 900 ml |
| Sodium Metabisulfite (anhydrous) | 10.0 g |
| Glacial Acetic Acid | 25.0 ml |
| Sodium Acetate | 10.0 g |
| EDTA.4Na | 0.7 g |
| PBA | 5.5 g |
| Water to make | 1.0 l |
| pH (27° C.) | 3.8 ± 0.2 |
| (6) Bleach | |
| Water (24–38° C.) | 800 ml |
| Gelatin | 0.5 g |
| Sodium Persulfate | 33.0 g |
| Sodium Chloride | 15.0 g |
| Monosodium Phosphate (anhydrous) | 9.0 g |
| Phosphoric Acid (85%) | 2.5 ml |
| Water to make | 1.0 l |
| pH (27° C.) | 2.3 ± 0.2 |
| (8) Fixing | |
| Water (20–38° C.) | 700 ml |
| Kodak Anti-Calcium No. 4 | 2.0 ml |
| 58% Solution of Ammonium Thiosulfate | 185 ml |
| Sodium Sulfite (anhydrous) | 10.0 g |
| Sodium Hydrogensulfite (anhydrous) | 8.4 g |
| Water to make | 1.00 l |
| pH (27° C.) | 6.5 |
| (10) Stabilizing | |
| Water (21–27° C.) | 1.00 l |
| Kodak Stabilizer Additive: A Nonionic Surface Active Agent | 0.14 ml |
| Formalin (37.5% solution) | 1.50 ml |

PBA means 2-dimethylaminoethylisothiourea dihydrochloride.

The image sharpness was evaluated by determining the response function, i.e., modulation transfer function (MTF), and comparing the MTF values at a given spatial frequency. The determination of MTF was made by the method described in Masao Takano and Ikuo Fujimura, *Non-Destructive Test,* 16, pp. 472–482 (1967).

The results are shown in Table 1.

TABLE 1

| Sample | Emulsion in the Third Blue-Sensitive Emulsion Layer | Emulsion in the Third Green-Sensitive Emulsion Layer | MTF of Red-Sensitive Emulsion Layer 10/mm | 30/mm |
|---|---|---|---|---|
| 101 (Comparative Example) | Emulsion C (Comparative Emulsion) | Emulsion D (Comparative Emulsion) | 85 | 35 |
| 102 (Example of the Invention) | Emulsion A (Emulsion of the Invention) | Emulsion D (Comparative Emulsion) | 88 | 55 |

TABLE 1-continued

| Sample | Emulsion in the Third Blue-Sensitive Emulsion Layer | Emulsion in the Third Green-Sensitive Emulsion Layer | MTF of Red-Sensitive Emulsion Layer | |
|---|---|---|---|---|
| | | | 10/mm | 30/mm |
| 103 (Example of the Invention) | Emulsion C (Comparative Emulsion) | Emulsion B (Emulsion of the Invention) | 87 | 52 |
| 104 (Example of the Invention) | Emulsion A (Emulsion of the Invention) | Emulsion B (Emulsion of the Invention) | 93 | 65 |

The values given in Table 1 indicate clearly that compared with Comparative Examples, the present invention provides color photographic light-sensitive materials with markedly improved sharpness through the use of tabular emulsions irrespective of the position of the tabular grain emulsion in the light-sensitive system and with more markedly improved sharpness through the use of tabular emulsions both in the blue-sensitive emulsion layer and in the green-sensitive emulsion layer.

While the invention has been described in detail and with reference to specific embodiments thereof, it will be apparent to one skilled in the art that various changes and modifications can be made therein without departing from the spirit and scope thereof.

I claim:

1. A color photographic light-sensitive material comprising a support having thereon at least one layer each of a red-sensitive emulsion, a green-sensitive emulsion and a blue-sensitive emulsion, wherein at least 50% of the total projected area of silver halide grains in at least one of said emulsion layer is tabular grains of silver bromide or silver iodobromide which have a thickness of less than 0.12 micron and a diameter of less than 0.6 micron said tabular grains of silver bromide or silver iodobromide having a mean aspect ratio of at least 5.

2. A color photographic light-sensitive material of claim 1, wherein the total projected area of silver halide grains in at least one of said emulsion layers is at least 70%.

3. A color photographic light-sensitive material of claim 2, wherein the total projected area of silver halide grains in at least one of said emulsion layers is at least 90%.

4. A color photographic light-sensitive material of claim 1, wherein said emulsions are sensitized with gold, sulfur, or a combination of gold and sulfur.

* * * * *